US006824346B2

(12) United States Patent
Coblentz

(10) Patent No.: US 6,824,346 B2
(45) Date of Patent: Nov. 30, 2004

(54) METHOD AND APPARATUS FOR HANDLING BAGGED CARGO

(76) Inventor: W. Sam Coblentz, P.O. Box 383290, Germantown, TN (US) 38183-3290

( * ) Notice: Subject to any disclaimer, the term of this patent is extended or adjusted under 35 U.S.C. 154(b) by 1 day.

(21) Appl. No.: 10/319,196

(22) Filed: Dec. 14, 2002

(65) Prior Publication Data

US 2004/0115037 A1 Jun. 17, 2004

(51) Int. Cl.[7] ..... B66C 1/12; B63B 27/00

(52) U.S. Cl. ..... 414/803; 294/74; 294/150; 294/152

(58) Field of Search ..... 414/803; 294/74, 294/150, 152

(56) References Cited

U.S. PATENT DOCUMENTS 2,325,261 A * 7/1943 Mazzella ..... 57/362
2,430,071 A * 11/1947 Mitchell ..... 87/8
3,343,862 A * 9/1967 Holmes ..... 294/74
3,701,559 A * 10/1972 Marino et al. ..... 294/74
3,829,144 A * 8/1974 Nattrass ..... 294/74
4,022,507 A * 5/1977 Marino ..... 294/74
4,025,100 A * 5/1977 Bridgehouse ..... 294/74
4,448,451 A * 5/1984 Colson ..... 294/74
4,492,399 A * 1/1985 Randen et al. ..... 294/74
4,737,069 A * 4/1988 Coblentz ..... 414/802
4,834,439 A * 5/1989 van de Kamp ..... 294/74
5,647,522 A * 7/1997 Routh ..... 224/651
5,688,011 A * 11/1997 Gulley ..... 294/74
5,772,269 A * 6/1998 Henning et al. ..... 294/67.22
5,944,370 A * 8/1999 Ravet et al. ..... 294/74
6,193,293 B1 * 2/2001 Ybanez ..... 294/152
6,331,024 B1 * 12/2001 Gulley ..... 294/74
6,584,632 B1 * 7/2003 Mittenberger ..... 5/658

* cited by examiner

*Primary Examiner*—Douglas Hess
(74) *Attorney, Agent, or Firm*—Dowrey Rickards PLLC

(57) ABSTRACT

Cargo slings for lifting sacks of particulate material and slinging jigs for aiding the formation of stacks of cartons to be lifted by such cargo slings are described. Methods of using the cargo slings and jigs are likewise explained. One such cargo sling comprises two loop portions (eyes) adjacent its two ends, and has two strap portions connected directly or indirectly to the loops. The two straps form cargo lifting portions of the sling, and may be positioned under a stack of sacks of particulate materials such that the straps are spaced apart from one another.

13 Claims, 4 Drawing Sheets

METHOD AND APPARATUS FOR HANDLING BAGGED CARGO

BACKGROUND INFORMATION

1. Field of the Invention

The present invention relates to the field of cargo handling, and in particular, to the transportation, loading and unloading of stacks of bagged cargo, such as, for example, stacks of sacks of grain.

2. Background of the Invention

Many types of cargo, such as grains, animal feed, seeds, meal and flour, and other particulate materials, are shipped in sacks. In the past, such sacks have been made of materials such as burlap and polyester. Although the sacks vary in size, they have commonly been of about 33 inches in length by 18–19 inches in width by 7–8½ inches in thickness for 50 kg sacks. 25 kg sacks are of similar length and width, with reduced thickness. The product for which these bags are used may include wheat, corn, wheat flour, lentils, beans, animal feed, feed ingredients, as well as other particulate materials such as plastic pellets and fertilizers.

Sacks made of kraft paper, typically lined with a plastic material, have come into more prominent use for shipping products. Similar products to those described above may be shipped in the kraft bags but they are additionally suited to fine particular materials such as milk replacement products, cement, chemicals, food ingredients, powdered milk, corn and soy products, animal feed, seeds and the like. The 25 kg kraft paper sacks typically have dimensions of 28 inches in length by 16 inches in width with a thickness of 4–6 inches.

While there have been significant advances in the methods employed for the loading and unloading of vessels, the loading of bagged cargo is labor-intensive and time consuming, and labor costs for loading and unloading the vessels can be substantial. In addition, inefficient loading of a ship can increase transportation costs, as demurrage charges and the costs of owning and operating a vessel continue to be incurred while the ship is docked.

Another measure of efficiency in loading of ships is the stowage factor. The stowage factor may be calculated as of the volume occupied by the cargo divided by the mass of the cargo, such as cubic feet per ton. If sacks of cargo are loaded haphazardly into the hold of a vessel, it is inevitable that space will be wasted, and fewer tons of cargo will be stowed in a given volume.

In order to reduce the time a ship spends at the dock, sacks of products are frequently preslung, and stacks of such preslung sacks of products are lifted aboard the ship by the ship's gear or by a crane. One efficient method for doing this is disclosed in my U.S. Pat. No. 4,737,069, which is incorporated herein by this reference. The stacks of sacks may be preslung at any location, including aboard barges or trucks, at warehouses, and at the dock.

The stacks of sacks are typically formed of successive layers of four sacks lying side by side with their edges slightly overlapping. The sling extends under the bottom layer of sacks about midway between their ends. The ship's gear or crane may lift multiples of such stacks at a time using a spreader bar or the like, and may deposit them in the hold of the vessel in their stowage locations. The slings may be withdrawn from under the sacks, or may be left in place to facilitate unloading of the sacks from the ship. If a top strap is used across the top of the stack of cartons, of course, it must be released before the slings can be withdrawn.

Typically, cargo slings are made of a length of webbing with loops at each end. The loops are placed over hooks on the ship's gear for lifting cargo into and out of the hold of a ship. As mentioned above, multiple stacks of sacks of products may be lifted into the hold of a ship by using a spreader bar. This is a beam or truss that may be attached to the ship's gear or crane that carries multiple hooks along its length.

One problem that affects the stowage factor is the girdling of the sacks in the bottom layer. Since the products shipped in the sacks are generally particulate, and since the sacks are squeezed as they are lifted by a single strap of webbing, there is a tendency for the material to flow to the ends of the sack, and for the ends to bulge and sag downward. The bulging and sagging may occur to a lesser extent in layers of sacks above the lower layer. When the stack of sacks is landed in the ship, the result may be that the sacks forming the stack do not fully relax, resulting in the stack having a greater overall height, with an attendant increase in the stowage factor.

In addition, due to the material from which they are made and the relatively lower thickness of the sacks of product, the girdling problem is particularly acute for stacks of kraft paper sacks. In addition to the increase in stowage factor, moreover, the more-pronounced girdling of the kraft paper sacks and forces encountered when the stack of sacks are landed may result in tearing or rupture of the sacks, which is particularly undesirable when they contain food products. The problems are sufficiently pronounced with the kraft paper sacks that stacks of such sacks of products are at present viewed as not generally amenable to preslinging and loading using a single sling per stack.

The use of multiple slings per stack of sacks is considered undesirable, owing to the additional time required to presling the stacks. In addition, the time required to position an additional pair of loops per stack over the hooks of a spreader bar, and to remove them from the hooks is considered undesirable as it adds delay in the cycling of the ship's gear or crane that decreasing productivity.

SUMMARY OF THE INVENTION

In one aspect, the present invention provides a cargo sling having loops at its two ends and providing at least two strap portions for supporting stacks of sacks of products or other cargo. In another aspect of the invention a cross strap is provided for securing across the top of a stack of sacks of products or other cargo. In yet another aspect of the invention, adjacent stacks of sacks of cartons are unitized by one or more bands of strapping extending lengthwise beneath and above sacks forming the adjacent stacks of sacks of products. In another aspect of the invention, a method of loading a ship is provided in which cargo slings having at least two strap portions for supporting stacks of sacks of products or other cargo are used in the loading and unloading of a vessel.

DETAILED DESCRIPTION OF EMBODIMENTS OF THE INVENTION

Figure 1:
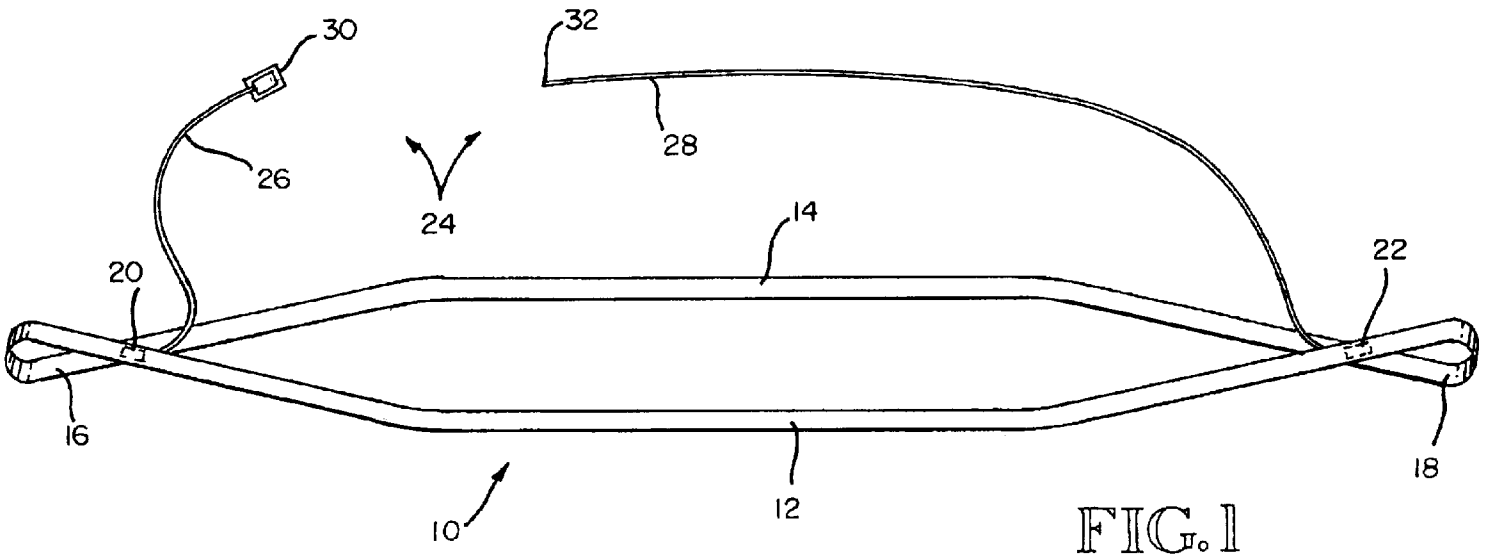
FIG. 1 is a perspective view of a sling 10 according to one embodiment of the invention.

FIG. 1 depicts a cargo sling 10 according to one embodiment of the invention. The sling 10 is formed of an endless loop of webbing material and comprises two cargo support portions 12, 14 and two loop portions 16, 18. The webbing may be any of a variety of materials with sufficient tensile strength to safely lift bagged cargo, and may be of either a woven or strip material so long as it provides sufficient strength and flexibility. Webbing woven from high tenacity polyester yarn may be used for the cargo sling 10. This material has high tensile strength and low elongation under load.

The endless loop of webbing material may either be formed as an endless loop, or the ends of a length of webbing material may be joined to form an endless loop. For example, the ends of such a length of webbing may be joined by sewing, riveting, thermal bonding, adhesives or other methods that will produce a sufficiently strong bond.

The loop portions 16, 18 of the cargo sling 10 of this embodiment may be formed by overlapping portions of the webbing material and joining them together. For example, the webbing material may be joined by a sewing, riveting, thermal bonding, adhesives or other methods that will join the overlapped portions 20, 22 sufficient to withstand the forces applied during lifting of stacks of sacks of product. The webbing of the overlapped portions 20, 22 of the cargo sling 10 may be joined such that the faces of the two webbing portions are at an angle to one another. The cargo sling of the present embodiment thus comprises a pair of loop portions at opposite ends and a center section comprising two cargo lifting portions. According to an alternate embodiment of the invention, a sling having two cargo lifting portions and two loops may also be fabricated from two strips of webbing in which a loop is formed in a first end of each strip, and the second end of each strip is joined to the other strip at a position proximate to the loop formed at one end of such other strip.

A top strap 24 made of similar webbing material and comprising a buckle portion 26 and tongue portion 28 may be provided. If the loop portions 16, 18 are sufficiently long, and the stack of sacks to be lifted are sufficiently tall that the overlap portions 20, 22 of the cargo sling 10 are not positioned above the level of the upper surface of a stack of sacks positioned in the cargo sling 10, then the ends of the buckle portion 26 and tongue portion 28 of the top strap 24 may be attached to the cargo sling 10 at or proximate to adjacent and the overlapped portions 20, 22.

Figure 2:
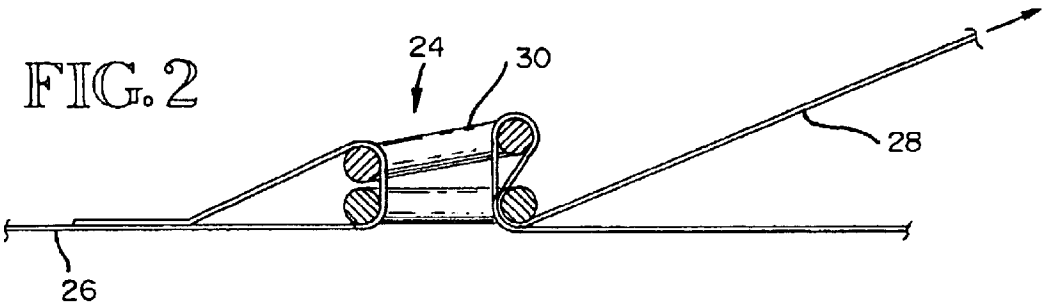
FIG. 2 is a partial sectional view of the cross strap portion of FIG. 1.

Referring next to FIG. 2 the buckle and tongue portions 26, 28 maybe releasably joinable by a buckle 30, that may be of metal, plastic or other suitable material. The tongue portion 28 of the top strap 24 may be of sufficient length that, when the two portions 26, 28 are joined over the top of a stack of sacks, and the stack of sacks is lifted by the loops 16, 18, a worker can reach the free end 32 of the tongue portion 28 to tighten the top strap 24. Non-releasable fasteners may also be used to join the two portions 26, 28 of the top strap 24, if desired. However, in such case, the top strap 24 would likely have to be cut at some point.

Figure 3:
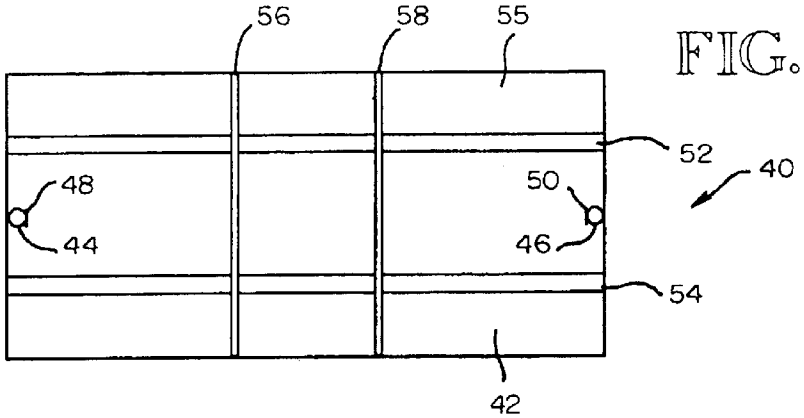
FIG. 3 is a top plan view of a stacking jig usable with the cargo sling of FIG. 1.
Figure 4:
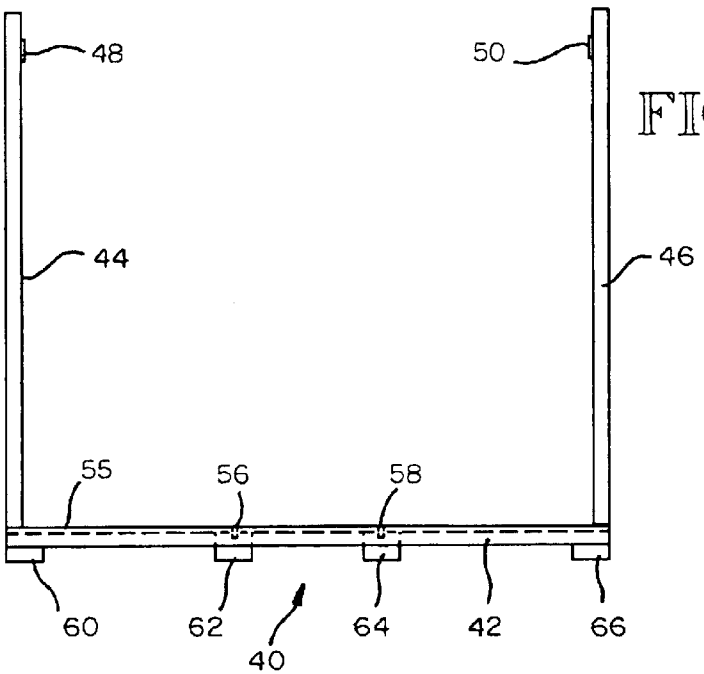
FIG. 4 is a side elevation of the stacking jig of FIG. 3.
Figure 5:
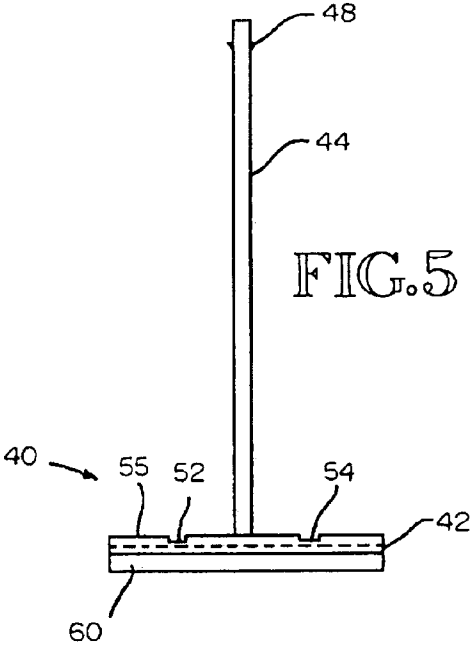
FIG. 5 is an end elevation of the stacking jig of FIG. 3.

FIGS. 3–5 depict an embodiment of a stacking jig 40 usable with a cargo sling 10 according to the present invention. The stacking jig 40 depicted in these figures is intended to accommodate four columns of sacks laid side to side. The stacking jig 40 comprises a base 42 and two uprights 44, 46 rigidly mounted to the base 42 and extending upward from it. Holders 48, 50 for releasably holding the cargo sling 10 during stacking of sacks in the stacking jig 40 may be mounted to the uprights 44, 46 adjacent their distal ends.

As shown in FIGS. 3–5, sling channels 52, 54 are formed in the upper surface 55 of the base 42 and extend laterally from one end of the stacking jig 40 to the other. The sling channels 52, 54 are generally parallel to one another and are spaced apart from the center line of the stacking jig 40 (a line drawn between the two uprights 44, 46) that they extend beneath a row of sacks laid side to side between the two uprights 44, 46. For example, the sling channels 52, 54 may be spaced apart so that slings positioned under a sack lying transversely to the sling channels 52, 54 are positioned at locations spaced inward from the ends of the sack by approximately one quarter of the length of the sack.

The spacing of the sling channels 52, 54 from the center line of the stacking jig 40 should be sufficient to avoid girdling of the sacks. Similarly, the sling channels 52, 54 should not be spaced so far apart (proximate the ends of the sacks) that the sacks are likely to bulge downward between the cargo support portions 12, 14 of the cargo sling 10 when a stack of sacks of product is lifted with the cargo sling 10. The sling channels 52, 54 should be sufficiently deep and sufficiently wide to accommodate the cargo lifting portions 12, 14 of the cargo sling 10 and to retain the cargo lifting portions 12, 14 as sacks of product are loaded into the stacking jig 40.

Banding channels 56, 58 are likewise formed in the upper surface 55 of the base 42. In the present embodiment, these channels 56, 58 are positioned such that, when a row of four sacks of product are placed in the stacking jig 40 in side to side engagement, the banding channels 56, 58 extend under the interior two sacks in the row. The banding channels 56, 58 may be deeper than the sling channels 52, 54 to allow banding material to be inserted in the channels 56, 58 beneath the bottom level of the sling channels 52, 54.

The base 42 may also include support 60, 62, 64, 66 to allow the blades of a lift truck to be inserted beneath the base 42. This permits the empty or laden stacking jig 40 to be moved or stored by means of a lift truck. Multiple bases 42 may be position side to side to allow for the creation, slinging and banding of multiple stacks of sacks The base 42 may be made of any of a variety of materials, such as plywood, dimensional lumber, metal, polymeric and composite materials etc. that have sufficient strength and rigidity to provide the necessary support for the uprights 44, 46 and for stacks of sacks to be formed thereon the uprights 44, 46 may be made of a rigid material, such as metal pipe.

According to one embodiment of the invention, a cargo sling such as cargo sling 10 may be used by laying the cargo support portions 12, 14 of the sling 10 on a surface in spaced apart relation to one another. A stack of sacks of products may then be formed atop the cargo sling 10, with the stack centered between the loop 16, 18 of the cargo sling 10. If desired, the top straps may then be buckled across the top of the stack of sacks. The loops 16, 18 may then be biased upwardly and toward one another to engage the stack of sacks and, as desired, the top strap 24 may be tightened, for example, by pulling on the free end 32 of the tongue 28.

Figure 6:
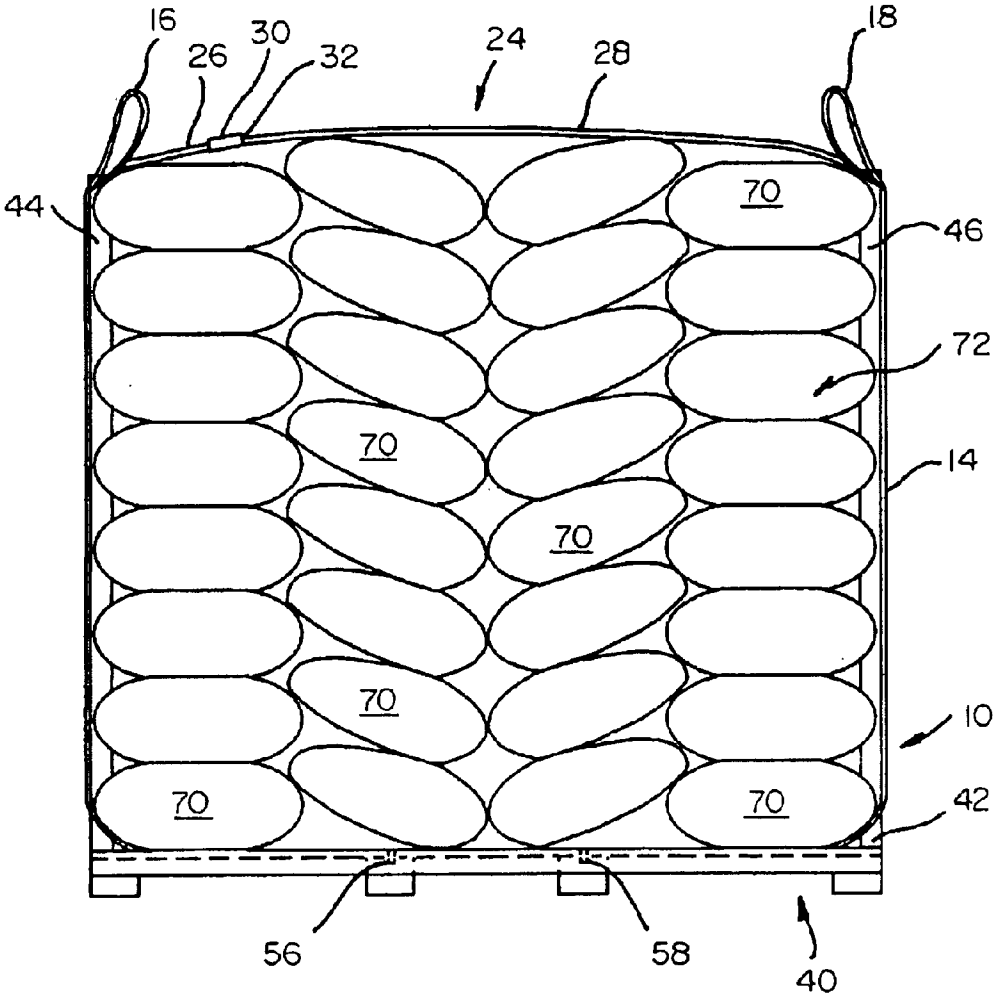
FIG. 6 is a side elevation of a stack of sacks in the stacking jig of FIGS. 3–5 with a sling mounted in the jig.

This process of providing a cargo sling 10 around a stack of sacks may be facilitated by use of a stacking jig such as the stacking jig 40. According to one embodiment of the invention, and with reference to FIGS. 6 and 7, the cargo sling is fastened to the uprights 44 of the empty stacking jig 40 and the cargo support portions 12, 14 of the cargo sling 12 are positioned in respective ones of the sling channels 52, 54. Successive layers of sacks 70 are then laid between the uprights 44, 46. The sacks 70 may be deposited in a layer by first depositing the outermost two bags 70 in firm engagement with the adjacent one of the supports 44, 46. The inner two sacks 70 may then be positioned with their edges overlapping the adjacent edges of the adjacent one of the outermost sacks 70. This process may be repeated until a stack 72 of the desired height has been formed. The top strap 24 may then be buckled over the top of the stack 72 of sacks 70.

In order to unitized the stack 72 of sacks 70, the stack 72 of sacks 70 may be choke lifted a short distance by upward and inward forces applied to the loop portions 16, 18. Once such tension has been applied to the cargo sling 10, the top strap 24 may be tightened. The stacking 72 of sacks 70 may then be transported, stored for later shipment, stacked, or loaded aboard a vessel.

Figure 7:
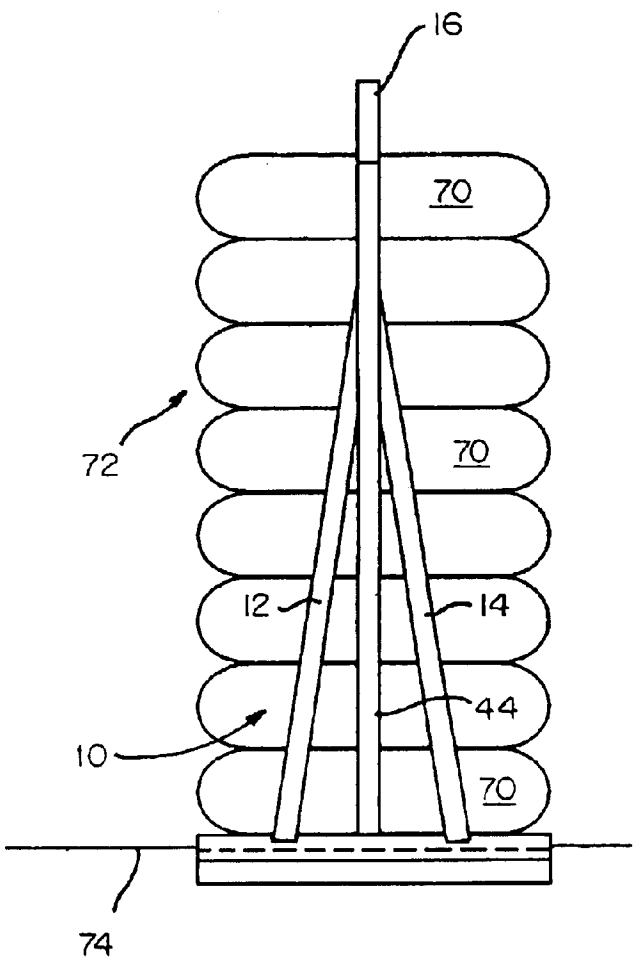
FIG. 7 is an end view of the stack of sacks in the staking jig of FIGS. 3–5 with a sling mounted in the jig.

As shown in FIG. 7, the stack 72 of sacks 70 may be further unitized by banding. Strips of the banding material 74 may be laid in the banding channels 56, 58 prior to positioning cargo sling 10 in the stacking jig 40. Once the stack 72 has been formed, the banding material 74 may be drawn tight and fastened about the stack 72 using a buckle, crimp fastener thermal welder or by other means.

Figure 8:
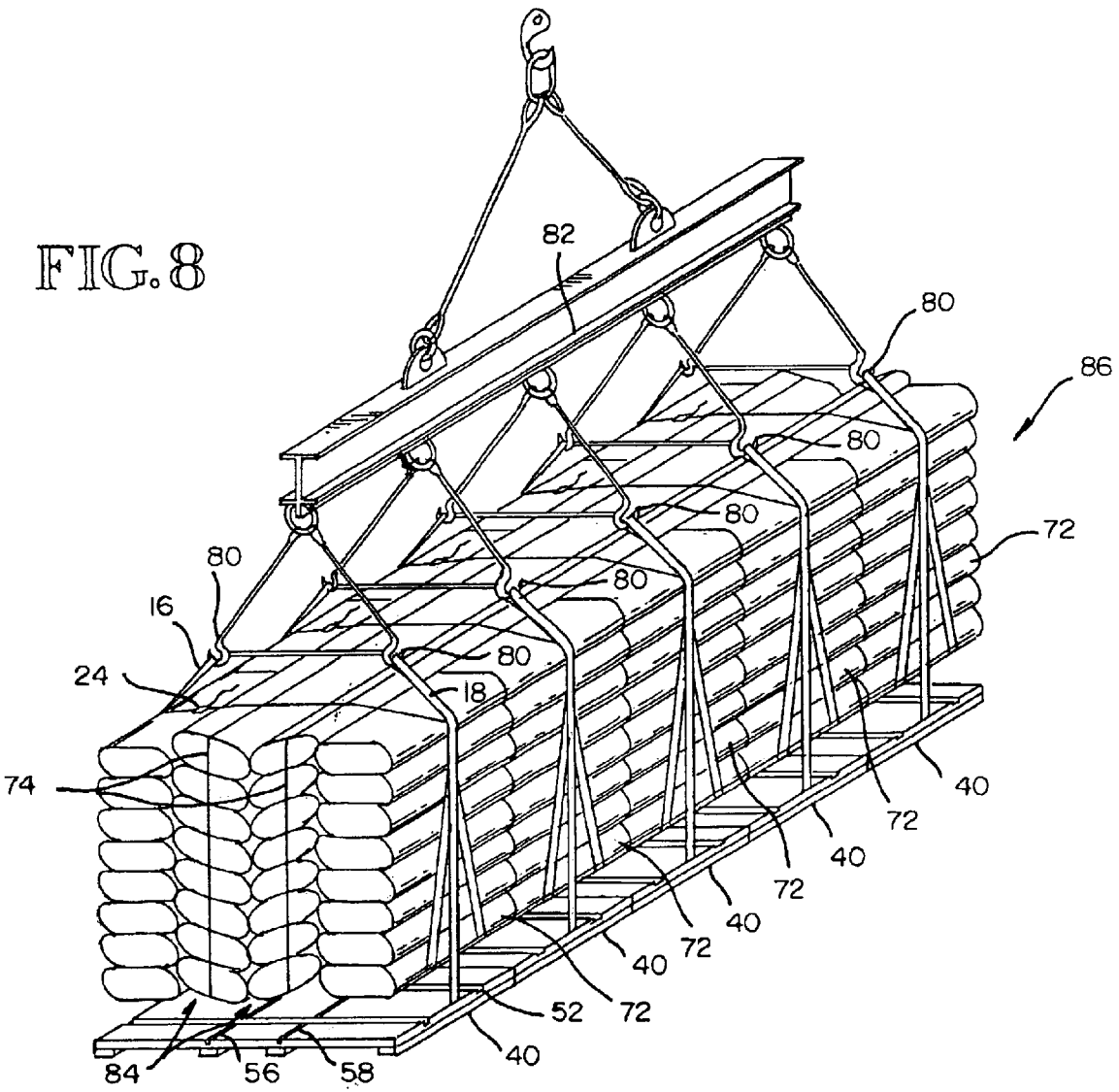
FIG. 8 is a perspective view of a unitized load comprising multiple stacks of sacks being lifted from stacking jigs.

FIG. 8 depicts a plurality of stacks 72 of sacks 70 being lifted from a plurality of adjacent stacking jigs 40. The stacking jigs 40 are positioned side to side with the banding channels 56, 58 of each stacking jig 40 in alignment with the banding channels 56, 58 of the adjacent stacking jig[s] 40. The loop portions 16, 18 of the cargo sling 10 of the successive adjacent the stack 72 of sacks 70 are engaged with respective pairs of hooks 80 that are, in turn, connected to a spreader bar 82 being lifted by the ship's gear or a crane. In order to unitize the stacks 72 of sacks 70, banding material has been fastened around the inner two columns 84 of sacks 70 to form a unitized load 86.

The unitized load 86 may be deposited by the ship's gear or a crane in a stowage location aboard a vessel. Depending on the height of the hold, multiple unitized loads 86 may be deposited on top of one another. Within the hold, a lift truck or other such device provided with a spreader bar may be used to lift one or more of the sacks 72 and by the cargo sling[s] 10 to transport them to a stowage location that may not be accessible to the ship's gear or to a crane.

Once a stack 72 of sacks 70 has been positioned in a stowage location, the top strap[s] 24 may be loosened to allow the sacks 70 of the stacks 72 to settle. This settling may improve the stowage factor of the stacks 72.

The cargo sling 10 may be removed from about the stack 72 by releasing the buckle 30 and releasing of one of the loop portions 16, 18 from one of the hooks 80. The cargo sling 10 may then be withdrawn by lifting the other of the hooks 80 on which the other of the loop portions 16, 18 is engaged. The cargo sling 10 may also be left in place to facilitate removal of the stack 72 of sacks 70 from the vessel. If a top strap 24 is used, the loop portions 16, 18 should remain accessible when the vessel is ready for unloading.

While the present invention has been described with reference to various embodiments, it will be apparent to those skilled in the art that modifications may be made within the scope of the invention.

What is claimed is:

1. A cargo sling having first and second ends for lifting stacks of sacks of particulate material comprising a continuous loop of webbing material, the sling having two opposite ends proximate to each of which the webbing of the loop is overlapped at an angle and fastened together to form a cargo-lifting eye at each end of the loop, the cargo-lifting eyes formed adjacent the first and second ends comprising the sole cargo-lifting eyes of the cargo sling, the cargo sling further comprising two cargo lifting portions extending between the overlapped portions of the webbing, the angle formed by the overlapped portions of the webbing being less than ninety degrees.

2. The cargo sling of claim 1 wherein the overlapped portions of the webbing material are joined by sewing.

3. The cargo sling of claim 2 wherein the webbing is formed of a material comprising high tenacity polyester yarn.

4. The cargo sling of claim 1 further comprising a top strap having first and second portions fastenable together, one end of the first portion of the top strap being connected to the loop of webbing at a position proximate to the first loop portion and one end of the second portion of the top strap being attached to the loop of webbing at a position proximate to the second loop portion.

5. The cargo sling of claim 4 wherein the first and second portions of the top strap are releasably and adjustably fastenable together by means of a buckle.

6. A cargo sling having first and second ends and formed from a continuous loop of webbing material for lifting stacks of sacks of particulate material comprising:

first and second cargo-lifting eyes loop portions formed at the first and second ends, respectively, by overlapping portions of the continuous loop of webbing material at an angle less than ninety degrees, the overlapping portions being fastened together in the area of overlap, the first and second eyes being the only cargo-lifting eyes of the cargo sling;

first and second elongated cargo lifting portions of webbing material extending between the cargo-lift eyes, the length of the first and second elongated cargo lifting portions being greater than the width of the lower surface of stacks of sacks to be lifted by the cargo sling.

7. The cargo sling of claim 6 further comprising first and second top strap portions, one end of the first top strap portion being connected to the cargo sling at a location proximate to the first cargo-lifting eye and one end of the second top strap portion being connected to the cargo sling proximate to the second cargo-lifting eye, the first and second top strap portions being fastenable together.

8. The cargo sling of claim 6 wherein the webbing material comprises high tenacity polyester yarn.

9. A method of lifting a stack of sacks of particulate material arranged in layers of sacks, each such layer constituting a plurality of sacks positioned side to side, the method comprising:

providing the stack of sacks of particulate material at a lifting location on a cargo sling having first and second cargo-lifting eyes adjacent first and second ends of the cargo sling, and having first and second cargo lifting portions extending between the eyes, the first and second cargo supporting portions being the only cargo-supporting portions of the sling, each such cargo lifting portion being connected between the first and second eyes and underlying the bottom layer of sacks in the stack of sacks, the part of the first and second cargo lifting portions of the sling positioned beneath the stack of sacks being spaced apart from one another and being spaced inward from the ends of the sacks in the stack of sacks; and applying a lifting force to the eyes of the cargo sling having a lifting component and having a component that biases the eyes of the cargo sling toward one another.

10. The method of claim 9 further comprising securing a top strap over the top of the stack of cartons, the top strap comprising first and second ends connected to the cargo strap at positions below the upper surface of the stack of sacks.

11. The method of claim 10 wherein the stack of sacks is lifted from the lifting location into the hold of a vessel.

12. The method of claim 10 wherein the top strap is tightened across the top of the stack of cartons after the application of the force to the loop portions of the cargo sling.

13. The method of claim 9 wherein, after the stack of sacks is lifted into the hold of the vessel, a lifting force of sufficient magnitude is applied to only one of the loop portions of the cargo sling to withdraw the cargo sling from under the stack of cartons.

* * * * *